US005958834A

United States Patent [19]

Yamazaki et al.

[11] Patent Number: 5,958,834

[45] Date of Patent: Sep. 28, 1999

[54] THERMAL TRANSFER IMAGE RECEIVING SHEET

[75] Inventors: Masayasu Yamazaki; Mineo Yamauchi, both of Tokyo-to, Japan

[73] Assignee: Dai Nippon Printing Co., Ltd., Tokyo-to, Japan

[21] Appl. No.: 09/016,502

[22] Filed: Jan. 30, 1998

[30] Foreign Application Priority Data

Jan. 31, 1997 [JP] Japan ..... P09-031438

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 5,093,439 3/1992 Epstein et al. ..... 525/540

*Primary Examiner*—Bruce H. Hess
*Attorney, Agent, or Firm*—Ladas & Parry

[57] ABSTRACT

A thermal transfer image receiving sheet comprises a substrate sheet and a receptor layer disposed on at least one surface of the substrate sheet, wherein the thermal transfer image receiving sheet contains sulfonated polyaniline as an antistatic agent. The sulfonated polyaniline may be contained in the receptor layer or another layer additionally formed on a front or back surface side of the thermal transfer image receiving sheet.

11 Claims, 1 Drawing Sheet

THERMAL TRANSFER IMAGE RECEIVING SHEET

BACKGROUND OF THE INVENTION

1. Field of the Invention

The present invention relates to a thermal transfer image receiving sheet. More specifically, the present invention relates to a new thermal transfer image receiving sheet having an excellent antistatic property.

2. Description of the Related Art

Various types of the thermal transfer methods are known. As one of the above methods, there is known the following sublimation thermal transfer method. More specifically, a thermal transfer sheet is prepared in such manner that a sublimation dye as a recording agent is supported by such a substrate sheet as a paper, or a plastic sheet. Using the thus prepared thermal transfer sheet, various full color images are formed on a thermal transfer image receiving sheet enabling to be dyed by the sublimation dye, such as a thermal transfer image receiving sheet manufactured by forming a dye receptor layer on the surface of a paper or plastic film.

In the sublimation thermal transfer method, a thermal head of a printer is used as heating means. With the use of the thermal head of the printer, the multicolored dots comprising three or four colors are transferred to the thermal transfer image receiving sheet by heating for a short time, thus reproducing full color image of the original by the above multicolored dots.

In the above sublimation thermal transfer method, the used coloring material is a dye. Since the thus formed image is very clear and excellent in transparency because of the dye used as the coloring material, the obtained image is excellent in the reproduction of the intermediate color and the gradation similarly to an image obtained by the conventional offset printing or gravure printing, furthermore, the high quality of image comparable to the full colors photographic image can be formed.

Although a plastic sheet, a laminated sheet composed of a plastic sheet and paper, a synthetic paper or the like are used as the thermal transfer image receiving sheet in the above sublimation thermal transfer method, a plain paper such as a coated paper (an art paper), a cast coated paper, a PPC paper is desired to be used as the substrate sheet for the thermal transfer image receiving sheet, in order to expand the use of the thermal transfer image receiving sheet into a general office field. Furthermore, since the sublimation thermal transfer method is effective in forming an OHP image, there is a demand for a thermal transfer image receiving sheet for the OHP which is capable of forming a quality image excellent in transparency or the like.

The above thermal transfer image receiving sheet has the following problems: more specifically, since various materials used for the thermal transfer image receiving sheet, especially the above various materials used as the substrate sheet have a high surface electrical resistance, the thermal transfer image receiving sheet is easily charged with static electricity by friction when the substrate sheet is manufactured, when a cushion layer, a dye receptor layer, a back surface layer (a slip layer) or the like is formed, when the thermal transfer image receiving sheet is rolled up or cut out, or when the thermal transfer image receiving sheet is put in cartridges or cases. Furthermore, while the thermal transfer image receiving sheet is used, the thermal transfer image receiving sheet is easily charged with static electricity when the thermal transfer image receiving sheet contacts with feeding rolls or thermal transfer sheets, or when the thermal transfer image receiving sheet is peeled off the thermal transfer sheet after printing.

When the thermal transfer image receiving sheet is charged with static electricity, dusts or the like are easily adhered on the surface thereof. Besides, when the thermal transfer sheet clings to the thermal transfer image receiving sheet due to the static electricity, only the thermal transfer sheet is stretched by the thermal head and it may be wrinkled. Such adhesion of the dusts and wrinkles of the thermal transfer sheet result in a deteriorated resolution of the formed image. In addition, the thermal transfer sheet is also charged with static electricity owing to the charged thermal transfer image receiving sheet, and thus they cling to each other to lower a conveying ability of the thermal transfer sheet and the thermal transfer image receiving sheet. Furthermore, in worse case, it is sparked or the body of human being is shocked when the thermal transfer sheet or the thermal transfer image receiving sheet is exchanged or inserted. The above mentioned problem is caused to occur not only in the opaque transparent thermal transfer image receiving sheet essentially comprising a paper substrate material but also in the transparent thermal transfer image receiving sheet used for the OHP or the like.

In order to prevent the above mentioned charge with static electricity from occurring, it is known that a surface active agent is applied on the front surface of the thermal transfer image receiving sheet to form an antistatic layer. However, the use of the surface active agent has caused a problem in which adhesiveness occurs in the surface of the thermal transfer image receiving sheet, or the antistatic layer thus formed is transferred to the back surface layer of the thermal transfer image receiving sheet when the thermal transfer image receiving sheet is stored in the form of piling or rolling. Furthermore, together with the above problem, the antistatic effect is lowered as time passes.

There is known another method in which a conductive layer is formed by using a conductive agent such metal oxides as a conductive carbon black or a tin oxide, and a binder. However, the above conductive agent has a black color or the like, thus deteriorating the appearance of the obtained thermal transfer image receiving sheet.

As the method to overcome the above problem, there is proposed, in the Japanese Patent Application Laid-Open (Kokai) No. 2-182,491, a method in which the antistatic layer is formed by using an acrylic resin having a functional group of a quaternary ammonium salt. However, since the above mentioned material forming the antistatic layer has basically inferior adhesiveness to the substrate or other resin, useful material is very restricted within a narrow range. Furthermore, the antistatic property varies occasionally under the circumstances.

SUMMARY OF THE INVENTION

The object of the present invention is to provide a thermal transfer image receiving sheet which steady keeps an excellent antistatic property, especially a sublimation thermal transfer image receiving sheet which steady keeps an excellent antistatic property.

To attain the above object, there is provided a thermal transfer image receiving sheet comprising a substrate sheet and a receptor layer disposed on at least one surface of the substrate sheet, wherein the thermal transfer image receiving sheet contains sulfonated polyaniline as an antistatic agent.

The thermal transfer image receiving sheet preferably comprises that the sulfonated polyaniline is contained in the receptor layer.

The thermal transfer image receiving sheet preferably comprises that an antistatic layer is further disposed between the substrate sheet and the receptor layer, and the sulfonated polyaniline is contained in the antistatic layer.

The thermal transfer image receiving sheet preferably comprises that a back surface layer is further disposed on an opposite surface of the substrate sheet on which the receptor layer is formed, and the sulfonated polyaniline is contained in the back surface layer.

The thermal transfer image receiving sheet preferably comprises that an antistatic layer and a back surface layer are further disposed on an opposite surface of the substrate sheet on which the receptor layer is formed, in order from the substrate sheet, and the sulfonated polyaniline is contained in the antistatic layer.

According to the present invention mentioned above, there can be provided a thermal transfer image receiving sheet which steady keeps an excellent antistatic property by the use of sulfonated polyaniline as an antistatic agent.

DETAILED DESCRIPTION OF PREFERRED EMBODIMENTS

Now, embodiments of the thermal transfer image receiving sheet of the present invention are described in detail.

The thermal transfer image receiving sheet of the present invention comprises a substrate sheet and a coloring material receptor layer disposed on at least front surface side of the substrate sheet, at least, and further comprises other layers, as required. The sulfonated polyaniline as an antistatic agent is contained in the receptor layer or other layers, or present in the interface of the substrate sheet and one of the layers, or the interface of the two layers.

The preferable embodiments of the thermal transfer image receiving sheet of the present invention are described with reference to the drawings.

Figure 1:
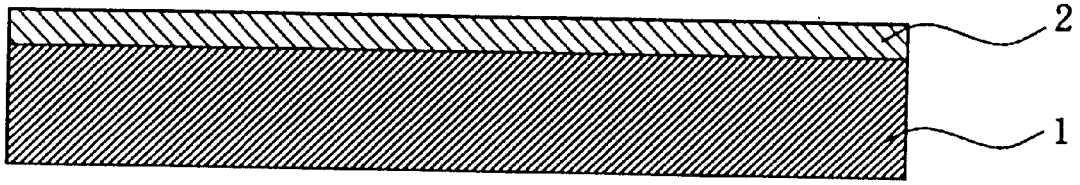
FIG. 1 is a schematic sectional view illustrating one of the embodiment of the thermal transfer image receiving sheet of the present invention.
Figure 2:
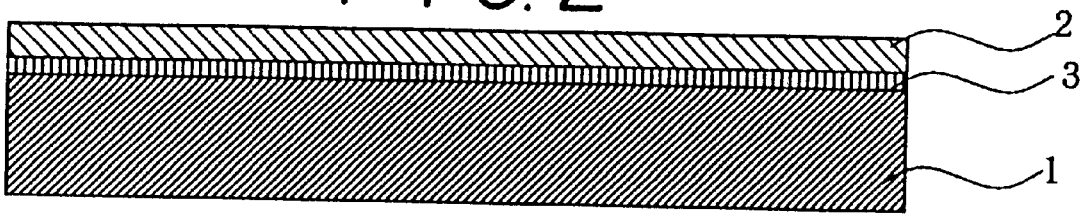
FIG. 2 is a schematic sectional view illustrating one of the other embodiment of the thermal transfer image receiving sheet of the present invention.
Figure 3:
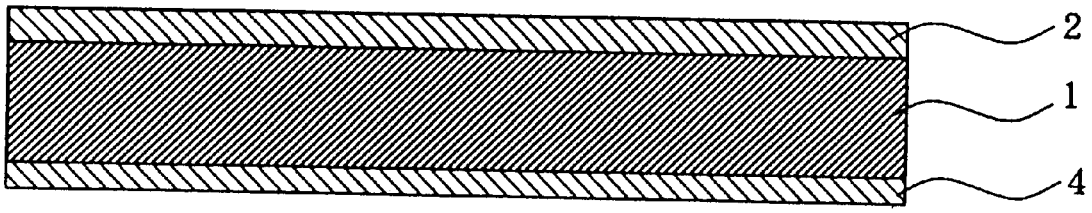
FIG. 3 is a schematic sectional view illustrating one of the other embodiment of the thermal transfer image receiving sheet of the present invention.
Figure 4:
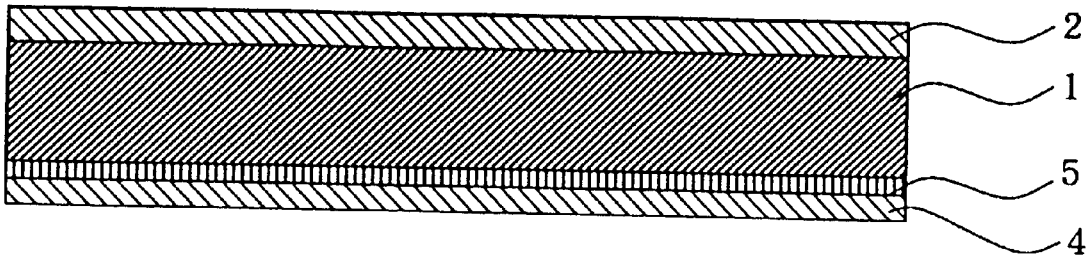
FIG. 4 is a schematic sectional view illustrating one of the other embodiment of the thermal transfer image receiving sheet of the present invention.

FIG. 1 is a schematic sectional view illustrating one of the embodiment of the thermal transfer image receiving sheet of the present invention, in which the sulfonated polyaniline as an antistatic agent is contained in the receptor layer 2 disposed on the front surface of the substrate sheet 1. FIG. 2 is a schematic sectional view illustrating one of the other embodiment of the thermal transfer image receiving sheet of the present invention, in which the antistatic layer 3 containing the sulfonated polyaniline is disposed between the substrate sheet 1 and the receptor layer 2. FIG. 3 is a schematic sectional view illustrating one of the other embodiment of the thermal transfer image receiving sheet of the present invention, in which the back surface layer (slip layer) 4 containing the sulfonated polyaniline as an antistatic agent is disposed on the surface of the substrate sheet 1 opposite to the surface thereof on which the receptor layer 2 is disposed. FIG. 4 is a schematic sectional view illustrating one of the other embodiment of the thermal transfer image receiving sheet of the present invention, in which the antistatic layer 5 containing the sulfonated polyaniline is disposed between the substrate sheet 1 and the back surface layer 4.

There are various sulfonated polyaniline used as an antistatic agent, which is one of the essential features of the present invention. One of the sulfonated polyaniline having the following structure is listed, as an example:

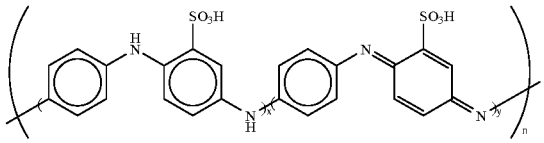

[In the above formula, each of x, y and n is integer setting a molecular weight of the sulfonated polyaniline within a range of about 300 to 10,000].

The above sulfonated polyaniline is dissolvable in a solvent containing water or alkali water, and converts into an intramolecular salt or an alkali salt in the solution. Those sulfonated polyaniline can be obtained, for example, through the product named as AQUA-SAVE-01Z manufactured by Nitto Kagaku Kogyo Co., Ltd., which may be in a form of an aqueous solution or solution in a mixed solvent of the water and an organic solvent, and that solution can be used for the present invention as it is. Those solution is usually yellowish, but almost transparent when its concentration is low.

As the substrate used in the present invention, there may be preferably used: various transparent or opaque plastic films or sheets; various papers such as a wood free paper, an art paper, a coated paper, a cast coated paper, a wall paper, a back lining paper, a synthetic resin or emulsion impregnated paper, a synthetic rubber latex impregnated paper, a synthetic resin lining paper and a paperboard; or the like. The thickness of those substrate sheet is not limited specifically, however, is preferably within a range of 30 to 200 $\mu$m.

It is possible to use a laminated body formed by laminating cushion layer on both surface of the above mentioned substrate sheet material as the substrate sheet, in which the cushion layer is made of the synthetic paper comprising a foamed resin sheet, for example, a foamed polypropylene, a foamed polyethylene, a foamed polystyrene or the like. The cushion layer preferably comprises a foamed polypropylene, in consideration of various strengths, cushion property or the like. The thickness of the cushion layer is preferably within a range of 30 to 80 $\mu$m.

Since a coating liquid for an antistatic layer mentioned later is excellent in adhesive property, the coating liquid for an antistatic layer can be used as an adhesive agent to laminate the materials for the substrate sheet. In addition, the sulfonated polyaniline may be added in the usual adhesive layer to obtain the same effect. In case of the adhesive sheet type thermal transfer image receiving sheet, the sulfonated polyaniline may be added in the adhesive agent layer formed on the back surface side of the substrate sheet. When the bonding strength between the substrate sheet and the receptor layer formed on the surface thereof is poor, it is preferable to apply the primer treatment or the corona discharge treatment on the surface of the substrate sheet.

The receptor layer on the substrate sheet is formed from an appropriate material suitable for fixing the coloring material therein. In the sublimation thermal transfer image receiving sheet, the dye receptor layer is formed to receive the sublimation dye transferred from the thermal transfer sheet and maintain the formed image. As a binder resin forming the dye receptor layer, there are listed: for example, polyolefin resin such as polypropylene; halide vinyl resin such as polyvinyl chloride, polyvinylidene chloride; vinyl resin such as polyvinyl acetate, polyacrylate; polyester resin such as polyethylene terephthalate, polybutylene terephthalate; polystyrene resin; polyamide resin; the copolymer of olefin such as ethylene, propylene or the like, and other vinyl monomer; ionomer; cellulose resin such as cellulose diacetate; polycarbonate; or the like. The vinyl resin and the polyester resin are especially preferable among the above.

A release agent may be preferably added in the above dye receptor layer in order to provide an excellent release property for the thermal transfer sheet. As a preferable release agent, there are listed silicone oil, phosphoric ester surface active agent, fluorine surface active agent or the like. In particular, the silicone oil is preferable. As the silicone oil, a modified silicone oil such as epoxy-modified, alkyl-modified, amino-modified, carboxyl-modified, alcohol-modified, fluorine-modified, alkyl aralkyl polyether-modified, epoxy/polyether-modified, polyether-modified or the like may be preferable.

One or more than two kinds of release agents may be used. The amount of the added release agent is preferably within a range of 1 to 20 weight parts to 100 weight parts of the binder resin forming the receptor layer. With the amount of the added release agent outside the above scope, there may be caused the problem in which the thermal transfer sheet and the dye receptor layer are fused to each other, or the printing sensitivity is lowered.

The thickness of the thus formed dye receptor layer is not specifically limited, however, is preferably within a range of 1 to 50 $\mu$m. The dye receptor layer preferably comprises a continuous structure (i.e., uniform structure). However, the dye receptor layer may comprise a discontinuous structure (i.e., not uniform structure) by using the resin emulsion or resin dispersion.

The dye receptor layer of the thermal transfer image receiving sheet of the present invention is prepared as follows: firstly, the above binder resin mixed with additives such as antioxidant, ultraviolet absorption agent as required, is dissolved into an appropriate organic solvent or dispersed into an appropriate organic solvent or water to prepare a solution or a dispersion, then thus prepared solution or dispersion is applied on at least one surface of the substrate sheet by a method such as gravure printing, screen printing, reverse roll coating using the gravure plate, and then dried to prepare the dye receptor layer.

In the embodiment shown in FIG. 1, the sulfonated polyaniline is contained in the receptor layer. The sulfonated polyaniline is contained in such a manner that the sulfonated polyaniline in an appropriate amount is added into the coating liquid for a receptor layer, and applying the above coating liquid on the substrate sheet. The amount of the added sulfonated polyaniline is usually within a range of about 0.1 to 10 weight parts to 100 weight parts of the above binder resin. With the amount of the sulfonated polyaniline being small outside the above scope, the desired antistatic effect cannot be obtained. On the other hand, with the amount of the sulfonated polyaniline being large outside the above scope, the receptor layer is colored, even though the antistatic effect is improved to reach the saturation, thus not preferable.

In the embodiment shown in FIG. 2, the antistatic layer containing the sulfonated polyaniline is formed between the substrate sheet and the receptor layer. When an appropriate binder is selected upon forming the antistatic layer, the antistatic layer may function as the primer layer to improve adhesiveness between the substrate sheet and the dye receptor layer. The antistatic layer containing the sulfonated polyaniline comprises the sulfonated polyaniline and the binder. An intermediate layer having some kind of function may be formed between the receptor layer and the antistatic layer, between the substrate sheet and the antistatic layer, between the back surface layer and the antistatic layer, as required.

As the binder for the antistatic layer, there are listed, for example, polyester resin, polyurethane resin, polyacrylic resin, polyvinylformal resin, epoxy resin, polyvinylbutyral resin, polyamide resin, polyether resin, polystyrene resin, styrene-acryl copolymer resin or the like. Water soluble or water dispersible polyester resin having a carboxyl group is preferable among the above resins in consideration of the properties of adhesion to the substrate sheet, compatibility to the sulfonated polyaniline, and adhesion to the heat resistant slip layer or the like, and furthermore the above water soluble or water dispersible polyester resin well functions as a primer layer. As the water soluble or water dispersible polyester resin having a carboxyl group, for example, the product named as POLYESTER-WR-961 manufactured by Nihon Gosei Kagaku Kogyo Co., Ltd. or the like is available and can be used for the present invention.

The antistatic layer shown in FIG. 2 is prepared with the use of the binder resin and the sulfonated polyaniline as essential ingredient in such manner that the binder and the sulfonated polyaniline are dissolved or dispersed in a solvent containing water, for example, a mixture of water and water soluble organic solvent such as methanol, ethanol, isopropyl alcohol, normal propyl alcohol or the like to prepare a coating liquid, then the thus prepared coating liquid is applied on the substrate sheet. The coating liquid may contain any additive such as a surface active agent to improve a wetting of the substrate sheet upon being coated, or defoaming agent to suppress bubbles. In particular, as the surface active agent, the phosphate ester surface active agent is preferably used.

The coating liquid for the antistatic layer preferably comprises about 2 to 10 wt. %, more preferably, 4 to 4.75 wt. % of binder resin, about 0.1 to 5 wt. %, more preferably, 0.25 to 1 wt. % of sulfonated polyaniline (in solid component), about 0 to 2 wt. %, more preferably, 0.2 to 1 wt. % of surface active agent, and the balance being solvent. The antistatic layer is formed by applying the above coating liquid on the one surface of the substrate sheet by the conventionally used coating means such as a gravure coater, a roll coater, a wire bar, and then dried.

The coating amount of the coating liquid for the antistatic layer is usually within a range of about 0.02 to 1.0 g/m$^2$, preferably, about 0.07 to 0.2 g/m$^2$. With the coating amount being small outside the above scope, the function as the antistatic layer may be not sufficient. On the other hand, with the coating amount being large outside the above scope, the function as the antistatic layer is not proportionately improved as the thickness increases, and it is not economical, thus not preferable.

In the embodiment shown in FIG. 3, the back surface layer containing the sulfonated polyaniline is formed on the back surface of the substrate sheet. The back surface layer is formed on the opposite side to the side of the substrate sheet on which the receptor layer is formed, so as to improve the conveying ability of the thermal transfer image receiving sheet in the printer, the slipping property to the thermal head, and the heat resistance. The back surface layer is formed from a binder resin excellent in slipping property such as acrylic resin and acryl silicone resin, and it may be contain an appropriate slipping particles. The thickness of the back surface layer is usually within a range of 1 to 5 g/m$^2$.

The process to incorporate the sulfonated polyaniline into the back surface layer, and the amount of the contained sulfonated polyaniline are the same as those in forming the dye receptor layer. More specifically, an appropriate binder resin, the slipping material and the sulfonated polyaniline are dissolved or dispersed in the solvent to prepare a coating liquid, then the thus prepared coating liquid is applied on the back surface of the substrate sheet. The amount of the added sulfonated polyaniline is usually within a range of about 0.1 to 10 weight parts to 100 weight parts of the binder resin forming the back surface layer.

In the embodiment shown in FIG. 4, the antistatic layer is formed between the substrate sheet and the back surface layer. The process to form the antistatic layer is the same as the process to form the antistatic layer between the receptor layer and the substrate sheet. The antistatic layer on the back surface side of the substrate sheet may be formed with the use of the same coating liquid as used in forming the antistatic layer on the front surface as described in FIG. 2. An applied amount of the coating liquid is also the same as in the formation of the antistatic layer on the front surface side.

The thermal transfer sheet, which is used with the thermal transfer image receiving sheet of the present invention, comprises a paper or a polyester film with a dye layer containing sublimation dye formed thereon. The conventionally known thermal transfer sheets can be used in the present invention, as they are.

In the thermal transfer process, heat energy can be provided by the conventional means. For example, the recording time is controlled to provide the thermal energy of about 5 to 100 mJ/mm$^2$ by means of the recording equipment such as a thermal printer (for example, Video Printer-VY-100 available from Hitachi Seisakusyo Co., Ltd.) or the like, thus attaining a desired image.

According to the present invention, the thermal transfer image receiving sheet steady keeping an excellent antistatic property can be obtained by the use of the sulfonated polyaniline as the antistatic agent. Furthermore, since the thermal transfer image receiving sheet of the present invention is excellent in transparency, it can be used for the OHP sheet or the like capable of being subjected to the thermal transfer.

EXAMPLE

The present invention is explained in detail with reference to the example of the present invention and the example for comparison. In the examples, "part(s)" and "%" mean as "weight part(s)" and "% by weight" respectively except a particular noting. In addition, an amount of each component contained in the respective coating liquid is described in terms of a solid substance.

Example 1

The PET film having a thickness of 100 $\mu$m (LUMIRROR manufactured by Toray Co., Ltd.) was used as the substrate sheet. A coating liquid for a dye receptor layer 1 having the following composition was applied to the above substrate sheet by Mayer bar, and then dried, thus forming the dye receptor layer with an applied amount of 2.5 g/m$^2$ (in dried condition).

<Coating Liquid for Dye Receptor Layer 1>

Sulfonated polyaniline (manufactured by Nitto Kagaku Kogyo Co., Ltd.): 1.2 weight parts Polyester resin (VYLONAL MD1245, manufactured by Toyo Boseki Co., Ltd.): 23.1 weight parts Silicone (KM-764E, manufactured by Shinetsu Kagaku Kogyo Co., Ltd.): 2.5 weight parts Catalyst (CAT-PM-4E, manufactured by Shinetsu Kagaku Kogyo Co., Ltd.): 0.2 weight parts Water: 36.5 weight parts IPA: 36.5 weight parts.

Then, a coating liquid for a back surface layer 1 having the following composition was applied to the opposite surface to that of the substrate sheet on which the receptor layer was formed, and then dried, to form the back surface layer with an applied amount of 1.5 g/m$^2$ (in dried condition), thus preparing the thermal transfer image receiving sheet of the present invention.

<Coating Liquid for Back Surface Layer 1>

Acrylic resin (BR-85, manufactured by Mitsubishi Rayon Co., Ltd.): 19.8 weight parts Nylon filler (MW-330, manufactured by Shinto Toryo Co., Ltd.): 0.6 weight parts MEK: 39.1 weight parts Toluene: 39.1 weight parts.

Example 2

The transparent PET film having a thickness of 100 $\mu$m was used as the substrate sheet. A coating liquid for an antistatic layer 1 having the following composition was applied to one surface of the above substrate sheet, and then dried, thus forming the antistatic layer with an applied amount of 0.5 g/m$^2$ (in dried condition).

<Coating Liquid for Antistatic Layer 1>

Sulfonated polyaniline (manufactured by Nitto Kagaku Kogyo Co., Ltd.): 0.5 weight parts Polyester resin (POLYESTER-WR-961, manufactured by Nihon Gosei Kagaku Kogyo Co., Ltd.): 9.5 weight parts Phosphoric ester surface active agent (PLYSURF 212C, manufactured by Daiichi Kogyo Seiyaku Co., Ltd.): 0.2 weight parts Water: 44.8 weight parts IPA: 45.0 weight parts.

Then, a coating liquid for a dye receptor layer 2 having the following composition was applied to the surface of the above antistatic layer, and then dried, to form the dye receptor layer with an applied amount of 2.5 g/m$^2$ (in dried condition).

<Coating Liquid for Dye Receptor Layer 2>

Vinyl chloride—vinyl acetate copolymer (#1000A, manufactured by Denki Kagaku Kogyo Co., Ltd.): 19.6 weight parts Silicone (X62-1212, manufactured by Shinetsu Kagaku Kogyo Co., Ltd.): 2.0 weight parts Catalyst (CAT-PL-50T, Shinetsu Kagaku Kogyo Co., Ltd.): 0.2 weight parts MEK: 39.1 weight parts Toluene: 39.1 weight parts.

Then, the same back surface layer as that in Example 1 was formed on the opposite surface to that of the substrate sheet on which the dye receptor layer was formed, thus preparing the thermal transfer image receiving sheet of the present invention to be used as OHP sheet.

Example 3

The thermal transfer image receiving sheet was prepared in the same manner in that of Example 1 except that the antistatic layer was formed under the back surface layer with the use of the coating liquid for the antistatic layer 1 in Example 2. In the thermal transfer image receiving sheet of Example 3, the sulfonated polyaniline was contained in both of the receptor layer and the antistatic layer formed between the substrate sheet and the back surface layer.

Example 4

The thermal transfer image receiving sheet was prepared in the same manner in that of Example 1 except that a coating liquid for a back surface layer 2 was used instead of the coating liquid for the back surface 1 in Example 1. In the thermal transfer image receiving sheet in Example 4, the sulfonated polyaniline was contained in both of the receptor layer and the back surface layer.

<Coating Liquid for Back Surface Layer 2>

Sulfonated polyaniline (manufactured by Nitto Kagaku Kogyo Co., Ltd.): 0.5 weight parts Polyester resin (POLYESTER-WR-961, manufactured by Nihon Gosei Kagaku Kogyo Co., Ltd.): 9.5 weight parts Phosphoric ester surface active agent (PLYSURF 212C, manufactured by Daiichi Kogyo Seiyaku Co., Ltd.): 0.5 weight parts Silica (SYLYSIA 445, manufactured by Fuji Shirishia Kagaku Co., Ltd.): 0.5 weight parts Water: 44.5 weight parts IPA: 44.5 weight parts.

Example 5

The thermal transfer image receiving sheet was prepared in the same manner in that of Example 2 except that a second antistatic layer was formed under the back surface layer with the use of the coating liquid for the antistatic layer 1 in Example 2 as well as between the substrate sheet and the dye receptor layer. In the thermal transfer image receiving sheet of Example 5, the sulfonated polyaniline was contained in both of the antistatic layer formed on the front surface side of the substrate and the antistatic layer formed on the back surface side of the substrate.

Example 6

The thermal transfer image receiving sheet was prepared in the same manner in that of Example 2 except that the coating liquid for the back surface layer 2 in Example 4 was used instead of the coating liquid for the back surface layer 1. In the thermal transfer image receiving sheet of Example 6, the sulfonated polyaniline was contained in both of the antistatic layer formed on the front surface side of the substrate sheet and the back surface layer.

Example 7

The thermal transfer image receiving sheet was prepared in the same manner in that of Example 3 except that the coating liquid for the dye receptor layer 2 in Example 2 instead of the coating liquid for the dye receptor layer 1. In the thermal transfer image receiving sheet of Example 7, the sulfonated polyaniline was contained in the antistatic layer formed between the substrate sheet and the back surface layer.

Example 8

The thermal transfer image receiving sheet was prepared in the same manner in that of Example 4 except that the coating liquid for the dye receptor layer 2 in Example 2 instead of the coating liquid for the dye receptor layer 1 In the thermal transfer image receiving sheet in Example 8, the sulfonated polyaniline was contained in the back surface layer.

Example 9

The adhesive sheet type thermal transfer image receiving sheet of the present invention is described in the example. The PET film (W400, manufactured by Diafoil Hoechist Co., Ltd.) having a thickness of 100 $\mu$m was used as the stripping sheet. The coating liquid for a release layer having the following composition was applied to one surface of the above substrate, and then dried, thus forming the release layer with an applied amount of 0.2 g/m$^2$ (in dried condition).

<Coating Liquid for Release Layer>

Silicone (KS-847H, manufactured by Shinetsu Kagaku Kogyo Co., Ltd.): 20.0 weight parts Catalyst (CAT-PL-50T, manufactured by Shinetsu Kagaku Kogyo Co., Ltd.): 0.4 weight parts MEK: 39.8 weight parts Toluene: 39.8 weight parts.

Then, the foamed PET film (W900I, manufactured by Diafoil Hoechist Co., Ltd.) having a thickness of 50 $\mu$m was used as the substrate sheet for the image receiving sheet. The coating liquid for an adhesive layer having the following composition was applied to one surface of the above substrate sheet, and then dried, thus forming the adhesive layer with an applied amount of 7.0 g/m$^2$ (in dried condition).

<Coating Liquid for Adhesive Layer>

Acrylic adhesive agent (SK DYNE 1310, manufactured by Soken Kagaku Co., Ltd.): 20.0 weight parts Hardening agent (E-AX, manufactured by Soken Kagaku Co., Ltd): 0.2 weight parts Ethyl acetate: 79.8 weight parts.

Then, the release layer surface and the adhesive layer surface of the respective substrate sheets thus prepared were stuck each other to prepare the substrate sheet for adhesive sheet.

Then, the thus prepared substrate sheet was used, and the dye receptor layer and the back surface layer were formed on the respective surface of the above substrate sheet in the same manner as that in Example 4. In the thermal transfer image receiving sheet of Example 9, the sulfonated polyaniline was contained in the receptor layer and the back surface layer.

Comparative Example 1

The thermal transfer image receiving sheet of Comparative Example 1 was prepared in the same manner as that in Example 1 except that the sulfonated polyaniline was not used.

Comparative Example 2

The thermal transfer image receiving sheet of Comparative Example 2 was prepared in the same manner as that in Example 2 except that the sulfonated polyaniline was not used.

Comparative Example 3

The thermal transfer image receiving sheet of Comparative Example 3 was prepared in the same manner as that in Comparative Example 1 except that a coating liquid for an antistatic layer 2 having the following composition was applied on the surface of the dye receptor layer and the surface of the back surface layer (0.01 g/m$^2$), and dried.

<Coating Liquid for Antistatic Layer 2>

Cationic surface active agent (STATICIDE, manufactured by A.C.L. Co., Ltd.): 0.2 weight parts IPA: 99.8 weight parts.

The results are shown in the Table 1. As is clear from the Table 1, all the thermal transfer image receiving sheet of the present invention have excellent conveying ability and have no problem in other property, thus having the excellent total evaluation. Contrary to the above, the conveying ability were poor and jamming occurred in the comparative examples 1 to 3, and the dye receptor layer of the comparative example 4 had an inferior adhesiveness.

TABLE 1

| | | Surface Electrical Resistance (Ω) | | | | | |
|---|---|---|---|---|---|---|---|
| | | Before Printing | | After Printing | Conveing | | Total |
| | | 25° C./50% | 5° C./10% | 25° C./50% | Ability | Others | Evaluation |
| Examples | | | | | | | |
| 1 | Front | $8.0 \times 10^7$ | $8.0 \times 10^7$ | $8.0 \times 10^7$ | ○ | Note 1 | ○ |
| | Back | $>1.0 \times 10^{13}$ | $>1.0 \times 10^{13}$ | $>1.0 \times 10^{13}$ | | | |
| 2 | Front | $9.0 \times 10^9$ | $9.0 \times 10^9$ | $8.7 \times 10^9$ | ○ | Note 1 | ○ |
| | Back | $>1.0 \times 10^{13}$ | $>1.0 \times 10^{13}$ | $>1.0 \times 10^{13}$ | | | |
| 3 | Front | $8.0 \times 10^7$ | $8.0 \times 10^7$ | $8.0 \times 10^7$ | ○ | Note 1 | ○ |
| | Back | $1.0 \times 10^{10}$ | $1.0 \times 10^{10}$ | $1.0 \times 10^{10}$ | | | |
| 4 | Front | $8.0 \times 10^7$ | $8.0 \times 10^7$ | $8.0 \times 10^7$ | ○ | Note 1 | ○ |
| | Back | $2.5 \times 10^8$ | $2.5 \times 10^8$ | $2.5 \times 10^8$ | | | |
| 5 | Front | $9.0 \times 10^9$ | $9.0 \times 10^9$ | $9.0 \times 10^9$ | ○ | Note 1 | ○ |
| | Back | $1.0 \times 10^{10}$ | $1.0 \times 10^{10}$ | $1.0 \times 10^{10}$ | | | |
| 6 | Front | $9.0 \times 10^9$ | $9.0 \times 10^9$ | $9.0 \times 10$ | ○ | Note 1 | ○ |
| | Back | $2.5 \times 10^8$ | $2.5 \times 10^8$ | $2.5 \times 10^8$ | | | |
| 7 | Front | $>1.0 \times 10^{13}$ | $>1.0 \times 10^{13}$ | $>1.0 \times 10^{13}$ | ○ | Note 1 | ○ |
| | Back | $1.0 \times 10^{10}$ | $1.0 \times 10^{10}$ | $1.0 \times 10^{10}$ | | | |
| 8 | Front | $>1.0 \times 10^{13}$ | $>1.0 \times 10^{13}$ | $>1.0 \times 10^{13}$ | ○ | Note 1 | ○ |
| | Back | $2.5 \times 10^8$ | $2.5 \times 10^8$ | $2.5 \times 10^8$ | | | |
| 9 | Front | $7.8 \times 10^7$ | $7.8 \times 10^7$ | $7.8 \times 10^7$ | ○ | Note 1 | ○ |
| | Back | $2.5 \times 10^8$ | $2.5 \times 10^8$ | $2.5 \times 10^8$ | | | |
| Comparative Examples | | | | | | | |
| 1 | Front | $>1.0 \times 10^{13}$ | $>1.0 \times 10^{13}$ | $>1.0 \times 10^{13}$ | x | Note 2 | x |
| | Back | $>1.0 \times 10^{13}$ | $>1.0 \times 10^{13}$ | $>1.0 \times 10^{13}$ | | | |
| 2 | Front | $>1.0 \times 10^{13}$ | $>1.0 \times 10^{13}$ | $>1.0 \times 10^{13}$ | x | Note 2 | x |
| | Back | $>1.0 \times 10^{13}$ | $>1.0 \times 10^{13}$ | $>1.0 \times 10^{13}$ | | | |
| 3 | Front | $3.0 \times 10^8$ | $5.0 \times 10^{10}$ | $>1.0 \times 10^{13}$ | x | Note 2 | x |
| | Back | $2.5 \times 10^8$ | $7.0 \times 10^{10}$ | $2.5 \times 10^8$ | | | |
| 4 | Front | $2.0 \times 10^{10}$ | $7.0 \times 10^{10}$ | $2.0 \times 10^{10}$ | ○ | Note 3 | x |
| | Back | $1.0 \times 10^{10}$ | $7.0 \times 10^{10}$ | $1.0 \times 10^{10}$ | | | |

Note 1: No Problem
Note 2: Occurrence of Jamming
Note 3: Inferior Adhessiveness in Dye Receptor Layer Comparative Example 4

The thermal transfer image receiving sheet for Comparative Example 4 was prepared in the same manner as that in Example 5 except that a coating liquid for an antistatic layer 3 having the following composition was used instead of the coating liquid for the antistatic layer 1 to form the antistatic layers on both surface side of the thermal transfer image receiving sheet.

<Coating Liquid for Antistatic Layer 3>

Conductive acrylic resin (ELECOND PQ-50B, manufactured by Soken Kagaku Co., Ltd.): 20.0 weight parts Methanol: 80.0 weight parts.

[Test and Result]

Ten sheets of the thermal transfer image receiving sheet obtained in each of Examples and Comparative Examples were subjected to the continuous printing process by means of A4 type sublimation transfer printer, and evaluated in the conveying ability and the statistic electricity characteristics.

What is claimed is:

1. A thermal transfer image receiving sheet comprising a substrate sheet and a receptor layer disposed on at least one surface of the substrate sheet, wherein the thermal transfer image receiving sheet contains sulfonated polyaniline as an antistatic agent.

2. A thermal transfer image receiving sheet as claimed in claim 1, wherein said sulfonated polyaniline is contained in said receptor layer.

3. A thermal transfer image receiving sheet as claimed in claim 2, wherein said sulfonated polyaniline is contained in a ratio of 0.1 to 10 weight parts of said sulfonated polyaniline to 100 weight parts of a binder resin for said receptor layer.

4. A thermal transfer image receiving sheet as claimed in claim 1, wherein an antistatic layer is further disposed between said substrate sheet and said receptor layer, and said sulfonated polyaniline is contained in said antistatic layer.

5. A thermal transfer image receiving sheet as claimed in claim 4, wherein said antistatic layer is formed by applying a coating liquid for an antistatic layer comprising 2 to 10 wt. % of a binder resin for an antistatic layer, 0.1 to 5 wt. % of said sulfonated polyaniline, and a solvent as a balance on said substrate sheet, and drying same.

6. A thermal transfer image receiving sheet as claimed in claim 5, wherein said coating liquid for an antistatic layer further comprises up to 2 wt. % of a surface active agent.

7. A thermal transfer image receiving sheet as claimed in claim 1, wherein a back surface layer is further disposed on an opposite surface of said substrate sheet on which said receptor layer is formed, and said sulfonated polyaniline is contained in said back surface layer.

8. A thermal transfer image receiving sheet as claimed in claim 7, wherein said sulfonated polyaniline is contained in a ratio of 0.1 to 10 weight parts of said sulfonated polyaniline to 100 weight parts of a binder resin for said back surface layer.

9. A thermal transfer image receiving sheet as claimed in claim 1, wherein an antistatic layer and a back surface layer are further disposed on an opposite surface of said substrate sheet on which said receptor layer is formed, in order from said substrate sheet, and said sulfonated polyaniline is contained in said antistatic layer.

10. A thermal transfer image receiving sheet as claimed in claim 9, wherein said antistatic layer is formed by applying a coating liquid for an antistatic layer comprising 2 to 10 wt. % of a binder resin for an antistatic layer, 0.1 to 5 wt. % of said sulfonated polyaniline, and a solvent as a balance on said substrate sheet, and drying same.

11. A thermal transfer image receiving sheet as claimed in claim 10, wherein said coating liquid for an antistatic layer further comprises up to 2 wt. % of a surface active agent.

* * * * *